US008177065B1

(12) United States Patent
Thomas

(10) Patent No.: US 8,177,065 B1
(45) **Date of Patent: *May 15, 2012**

(54) OBJECT SUPPORT KIT FOR A BED FRAME

(76) Inventor: Frederick R. Thomas, Jacksonville, FL (US)

( * ) Notice: Subject to any disclaimer, the term of this patent is extended or adjusted under 35 U.S.C. 154(b) by 559 days.

This patent is subject to a terminal disclaimer.

(21) Appl. No.: 12/322,739

(22) Filed: Feb. 6, 2009

Related U.S. Application Data

(60) Provisional application No. 61/063,989, filed on Feb. 8, 2008.

(51) Int. Cl.
*B65D 69/00* (2006.01)

(52) U.S. Cl. ..... 206/376; 5/503.1

(58) Field of Classification Search ..... 206/576, 206/549; 5/507.1, 505.1, 659, 503.1; 211/8, 211/119.006, 64; 248/124.2, 229.1, 229.15, 248/229.25, 226.11

See application file for complete search history.

(56) References Cited

U.S. PATENT DOCUMENTS 598,895 A * 2/1898 Bell ..... 108/141
1,256,498 A * 2/1918 Baker ..... 108/139
3,009,676 A * 11/1961 Buchwald ..... 248/229.11
4,461,442 A 7/1984 Keenan
4,831,673 A * 5/1989 Winckler ..... 5/503.1
4,998,277 A * 3/1991 Rioux, Jr. ..... 379/454
D324,810 S 3/1992 Moye, Sr.
5,375,276 A * 12/1994 Nelson et al. ..... 5/620
D361,462 S 8/1995 Newham
5,605,235 A 2/1997 Johnson
5,651,152 A * 7/1997 Ritchie et al. ..... 5/503.1
5,802,636 A * 9/1998 Corbin et al. ..... 5/425
6,065,727 A 5/2000 Fitzgerald et al.
6,233,765 B1 * 5/2001 Verhulst ..... 5/503.1
6,594,836 B1 7/2003 Everson et al.
6,929,229 B1 * 8/2005 Palmby ..... 248/311.2
7,131,152 B2 11/2006 Wootten, Jr. et al.
7,175,143 B1 * 2/2007 Ho ..... 248/215
7,325,264 B2 * 2/2008 Holmes ..... 5/503.1

* cited by examiner

*Primary Examiner* — Jacob K Ackun
*Assistant Examiner* — Jenine Pagan
(74) *Attorney, Agent, or Firm* — Montgomery Patent & Design, LLC; Robert C. Montgomery; Joseph T. Yaksich

(57) ABSTRACT

A kit comprising a plurality of holding devices interchangeably attached thereto a side bed frame for storing various items and anchoring a pivoting tray table is herein disclosed. The kit provides storage of such items as television remotes, flashlights, bed operating controls, reading material, lotions, flashlight, snacks and even a handgun along a side bed frame as well as providing an anchoring means thereto a bed-side tray table. Each interchangeable holding device and anchor is attached to the side bed frame rail by means of a "U"-shaped clamp and wing nut mechanism allowing. The holders are available in multiple colors and styles and may be discreetly covered by a comforter, bedspread, or blanket when access is not required.

8 Claims, 7 Drawing Sheets

OBJECT SUPPORT KIT FOR A BED FRAME

RELATED APPLICATIONS

The present invention was first described in U.S. Provisional Patent Application No. 61/063,989 filed on Feb. 8, 2008, the entire disclosures of which are incorporated herein by reference.

FIELD OF THE INVENTION

The present invention relates to an object support kit for removable and selectable placement thereon a bed frame, comprising a plurality of object holsters and a tray table assembly in a portable carrying case.

BACKGROUND OF THE INVENTION

There are a multitude of small items such as television remote controls, books, tissues, and the like, of which quick access while in bed is desired and sometimes required. Typically these and other items are stored on or about a bedroom nightstand or in a drawer. The most reasonable place to store these items is in close proximity to a prospective user in bed however, many bedrooms do not have a nightstand on both sides of the bed or at all. Even in those that do, the above mentioned small items quickly form clutter on the top of the nightstand. Additionally, such items are prone to falling on the floor and are hard to access during the middle of the night in the dark. Accordingly, there exists a need for a means by which small personal items can be stored and easily accessed while in bed without the disadvantages as mentioned above. The development of the kit herein described fulfills this need.

A kit comprising a plurality of holding devices interchangeably attached to a bed side for storing such items as television remotes, flashlights, bed operating controls, reading material, lotions, flashlight, snacks and even a handgun is described. Any combination of interchangeable holding devices can be attached near the top of the bed sides as desired for specific needs. They are attached to a bed frame rail by means of a "U"-shaped clamp and wing nuts. The holding devices are available in multiple colors and styles and are easily covered by a comforter, bedspread, or quilt when access is not required.

Several attempts have been made in the past to overcome these problems and provide a means of conveniently storing commonly used articles in an easily accessible manner for a user while in bed. U.S. Pat. No. 5,605,235, issued in the name of Johnson, describes a holder for a plurality of remote control devices for controlling audiovisual equipment comprising an upwardly open pocket which can hold at least two (2) controllers and a planer support arm which enables the holder to be mounted to a chair, sofa, or bed mattress. However, unlike the present kit, the Johnson remote control holder is intended for use with only audiovisual controllers or similarly shaped articles and lacks any sort of interchangeability for various types of articles.

U.S. Pat. No. 4,461,442, issued in the name of Keenan, discloses a pistol holster bracket for mounting on the side of a bed comprising a bracket which slides and is secured between a mattress and a box spring and a vertical member which receives the belt loop of a holster. However, unlike the present kit, the Keenan holster holder for bed is limited for use only with pistols and similar handguns.

U.S. Pat. No. 6,594,836, issued in the name of Everson et al., discloses a bedding element comprising a fitted bottom sheet with one (1) or more elasticized pouches sewn onto both lateral sides of said sheet which provides a temporary location to store a variety of articles commonly used while in bed. However, unlike the present kit, the Everson bed sheet with convenience pouches does not provide a secure means of mounting the articles to the bed frame and does not provide individual holding devices intended for use with particularly shaped articles.

Other known prior art for holding and storing commonly used articles while in bed include U.S. Pat. Nos. 6,065,727 and 7,131,152.

Additionally, ornamental designs for articles holders and holsters exist in the prior art, particularly, U.S. Pat. Nos. D 324,810 and D 361,462. However, none of these designs are similar to the present kit.

While these devices fulfill their respective, particular objectives and appear to disclose various attempts to temporality store articles which are commonly used while a user is in bed; none of the prior art particularly discloses an object support kit for a bed frame comprising a plurality of individually adapted holding brackets which provide a means of conveniently and securely storing various articles in an interchangeable manner. Accordingly, there exists a need for an object support kit for a bed frame that operates without the disadvantages as described above.

SUMMARY OF THE INVENTION

In view of the foregoing prior art, the kit and devices described herein are contemplated to solve the aforementioned inherent disadvantages and it has been observed that there is need for an object support kit for a bed frame which provides a means to store, retain, and retrieve various articles commonly used while in bed.

To achieve the above objectives, it is an objective of the present kit and devices to provide an object support kit for a bed frame comprising a plurality of holder assemblies which provide a means of removably mounting various commonly used articles to an upper side support member of a bed frame.

A further object of the present kit and devices are to provide a plurality of holder assemblies comprising a holder plate, an anchor slot, an anchor plate, and tightening fasteners which provides a means of storing the various commonly used articles which are removably mounted to the bed frame.

Yet still another object of the present kit and devices are to provide a holder plate comprising a means of securing various articles to the holder assembly.

Yet still another object of the present kit and devices are to provide an anchoring slot comprising a "U"-shaped bracket formed by the holder plate and the parallel anchor plate which receives a rail portion of the bed frame and anchors the holder assembly to the bed frame.

Yet still another object of the present kit and devices are to provide a plurality of tightening fasteners which engage the bed frame once the anchoring slot receives an upper portion of the bed frame and provides a means of securely clamping the holder assembly to the bed frame.

Yet still another object of the present kit and devices are to provide a bed side table assembly comprising a tray table, a plurality of support posts, and a post receiver which provides a means of securely mounting a pivoting bedside tray table to the bed frame.

Yet still another object of the present kit and devices are to provide a carrying case comprising a plurality of holding cavities within foam padding which provides a convenient means of storing and transporting the various holder assemblies and bed side table assembly.

Yet still another object of the present kit and devices are to provide a method for utilizing a object support kit for a bed frame.

Further objects and advantages of the present kit and devices will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
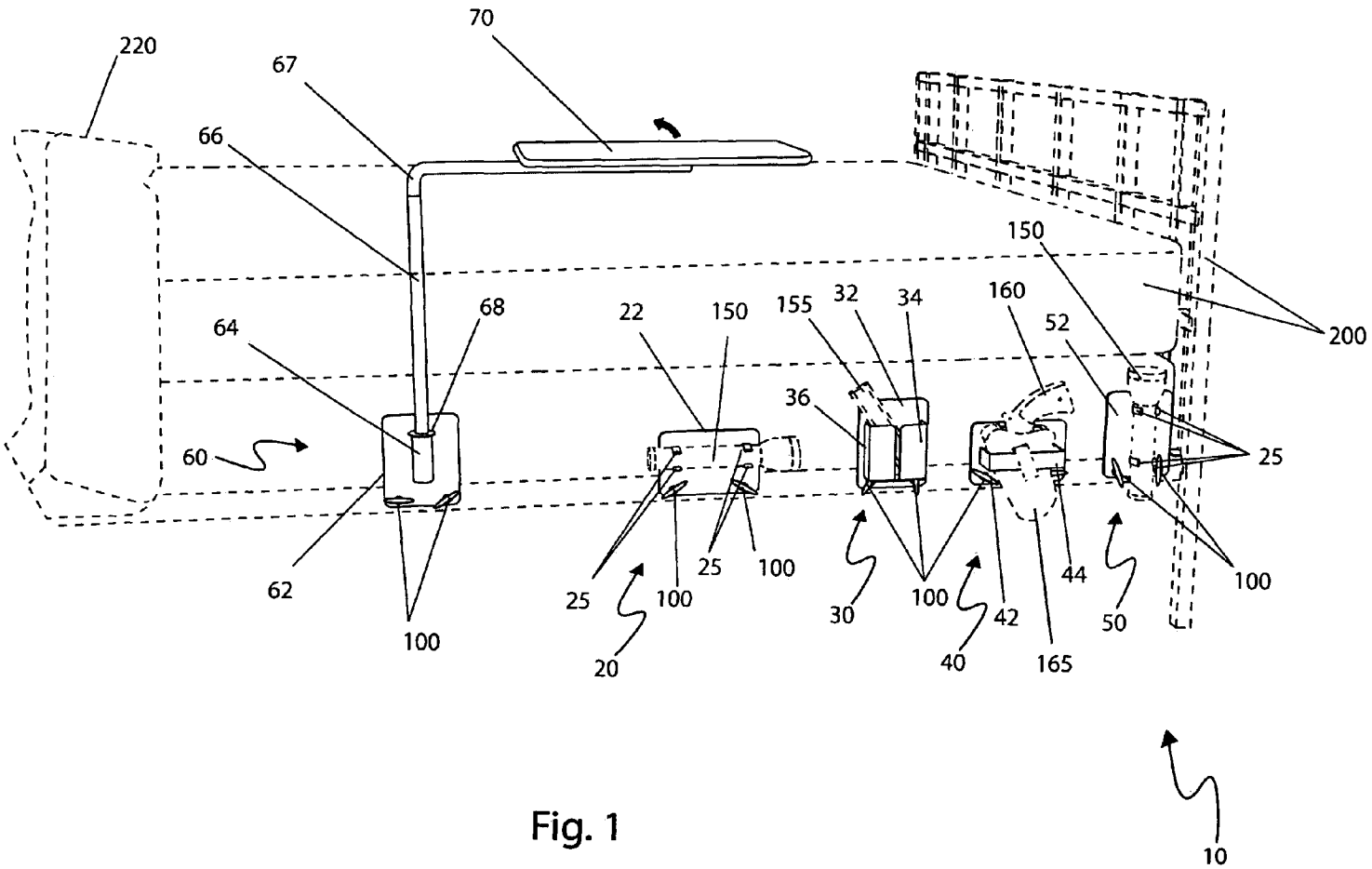
FIG. 1 is an environmental view of an object support kit for a bed frame 10 removably attached thereto a bed frame 210, according to the preferred embodiment of the present invention.

| | |
|---|---|
| 10 | object support kit for a bed frame |
| 20 | horizontal flashlight holder assembly |
| 22 | first flashlight holder plate |
| 23 | anchor slot |
| 24 | anchor plate |
| 25 | clip |
| 30 | miscellaneous items holder assembly |
| 32 | miscellaneous items holder plate |
| 33 | bottom wall |
| 34 | pocket front panel |
| 35 | slot portion |
| 36 | pocket side panel |
| 40 | pistol holder assembly |
| 42 | pistol holder front plate |
| 44 | first bracket |
| 50 | vertical flashlight holder assembly |
| 52 | second flashlight holder plate |
| 60 | bed side tray table assembly |
| 62 | bed side tray table plate |
| 64 | post receiver |
| 66 | first post |
| 67 | second post |
| 68 | pivot ring |

-continued

| | |
|---|---|
| 69 | connecting pin |
| 70 | tray table |
| 72 | second bracket |
| 80 | carrying case |
| 81 | lower case portion |
| 82 | upper case portion |
| 83 | hinge |
| 84 | foam padding |
| 85 | clasp |
| 87 | handle |
| 88 | cavity |
| 100 | wing bolt |
| 105 | threaded aperture |
| 150 | flashlight |
| 155 | remote control |
| 160 | pistol |
| 165 | holster |
| 200 | bed |
| 210 | side frame member |
| 220 | bed covering |

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an object support kit for a bed frame (herein described as the "apparatus") 10, which provides an anchoring means of a tray table 70 thereto a side bed frame 210 as well as a means to store, retain, and subsequently retrieve items such as, but not limited to: remote controls 31, flashlights 32, bed operating controls, reading material, lotions, snacks, and handguns 35 via a plurality of interchangeable holding devices secured to a side bed frame member 210. The apparatus 10 would be made principally of plastic materials using conventional injection molding processing. It is envisioned that the apparatus 10 would be made available in multiple colors and styles to match any bedroom décor. The various portions of the apparatus 10 are easily concealed using a bed spread or other like bed covering 220, thus providing additional security.

Referring now to FIG. 1, an environmental view of the apparatus 10 removably attached thereto a bed frame 210, according to the preferred embodiment of the present invention, is disclosed. The apparatus 10 comprises a plurality of support plates affixed thereto a side bed frame portion 210 of a conventional bed 200. The apparatus 10 comprises a horizontal flashlight holder assembly 20, a miscellaneous items holder assembly 30, a pistol holder assembly 40, a vertical flashlight holder assembly 50, and a bed-side tray table assembly 60. The apparatus 10 comprises suitable fixtures and features for receiving, holding, and providing easy access to retrieve items such as, but not limited to: flashlights 150, remotes 155, a handgun 160, bed operating controls, reading material, lotions, snacks, and other objects. Additionally, the apparatus 10 comprises an anchoring means thereto a pivoting tray table 70 along said side bed frame 210 being especially useful to a convalescing occupant or patient thereupon the bed 200.

It is envisioned that the apparatus 10 may be introduced in a variety of shapes, sizes, colors, patterns, and aesthetically pleasing motifs with or without being fashioned to resemble a surrounding décor exhibited throughout a bedroom; however, it is most preferred that the apparatus 10 would be decorated and/or designed to complement said décor of the bedroom in which the apparatus 10 is installed. Each portion of the apparatus 10 is removably installed thereupon a side bed frame portion 210 partially extending outwardly such that a bedcovering 220 such as a bedspread, bed sheet, and/or cover may be placed over said apparatus 10 and respective portions 20, 30, 40, 50, 60, thereby concealing underneath without negatively affecting an ability of said occupant to gain access thereto each portion 20, 30, 40, 50, 60.

Figure 2:
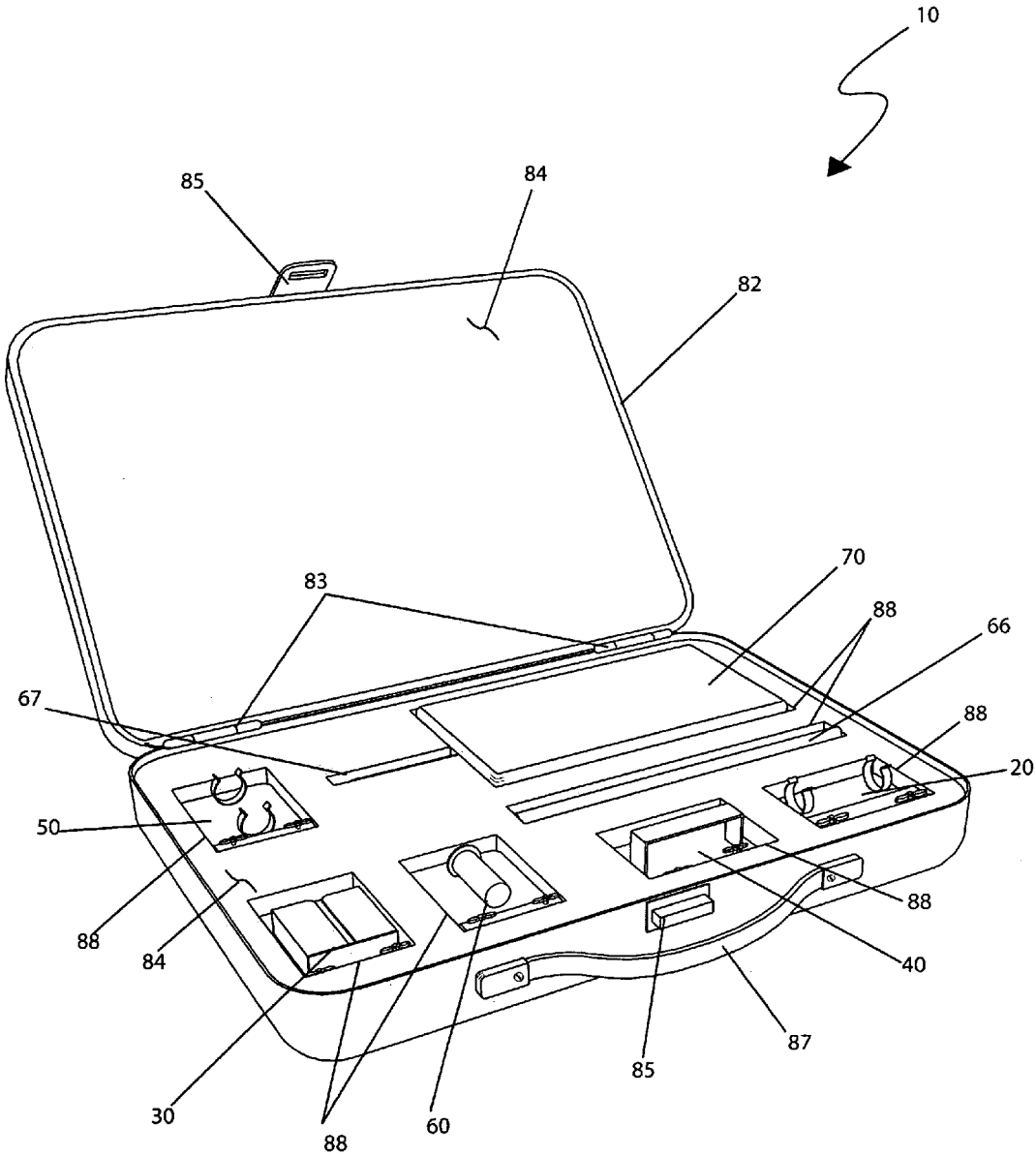
FIG. 2 is a perspective view of an object support kit for a bed frame 10, depicting storage of portions therein a carrying case portion 80, according to the preferred embodiment of the present invention.

Referring now to FIG. 2, a perspective view of the apparatus 10, depicting storage of portions therein a carrying case portion 80, according to the preferred embodiment of the present invention, is disclosed. The carrying case portion 80 of the apparatus 10 provides a kitting means thereto the apparatus 10 as well as providing a protective, compact, and portable containment thereto the aforementioned assemblies 20, 30, 40, 50, 60. The carrying case 80 comprises a generally rectangular metal or plastic hinging and latching enclosure approximately twenty-four (24) inches wide and eight (8) inches deep providing a padded isolation means thereto each assembly 20, 30, 40, 50, 60 therewithin via a plurality of cavities 88 which provide correspondingly-shaped openings therein. The carrying case 80 comprises conventional expected features being similar thereto a common briefcase including a deep lower case portion 81, a shallow upper case portion 82, a pair of hinges 83 along a single perimeter edge, internal foam padding 84 affixed thereto the upper 81 and lower 82 case portions, a latching clasp 85, and a common "U"-shaped handle 87. The foam padding 84 is envisioned to be made using protective materials such as urethane, polystyrene, or the like. The carrying case 80 provides a means to use one (1) or more of the assemblies 20, 30, 40, 50, 60 in a selective manner while storing unused portions therewithin said carrying case 80 in a convenient location until needed.

Figure 3:
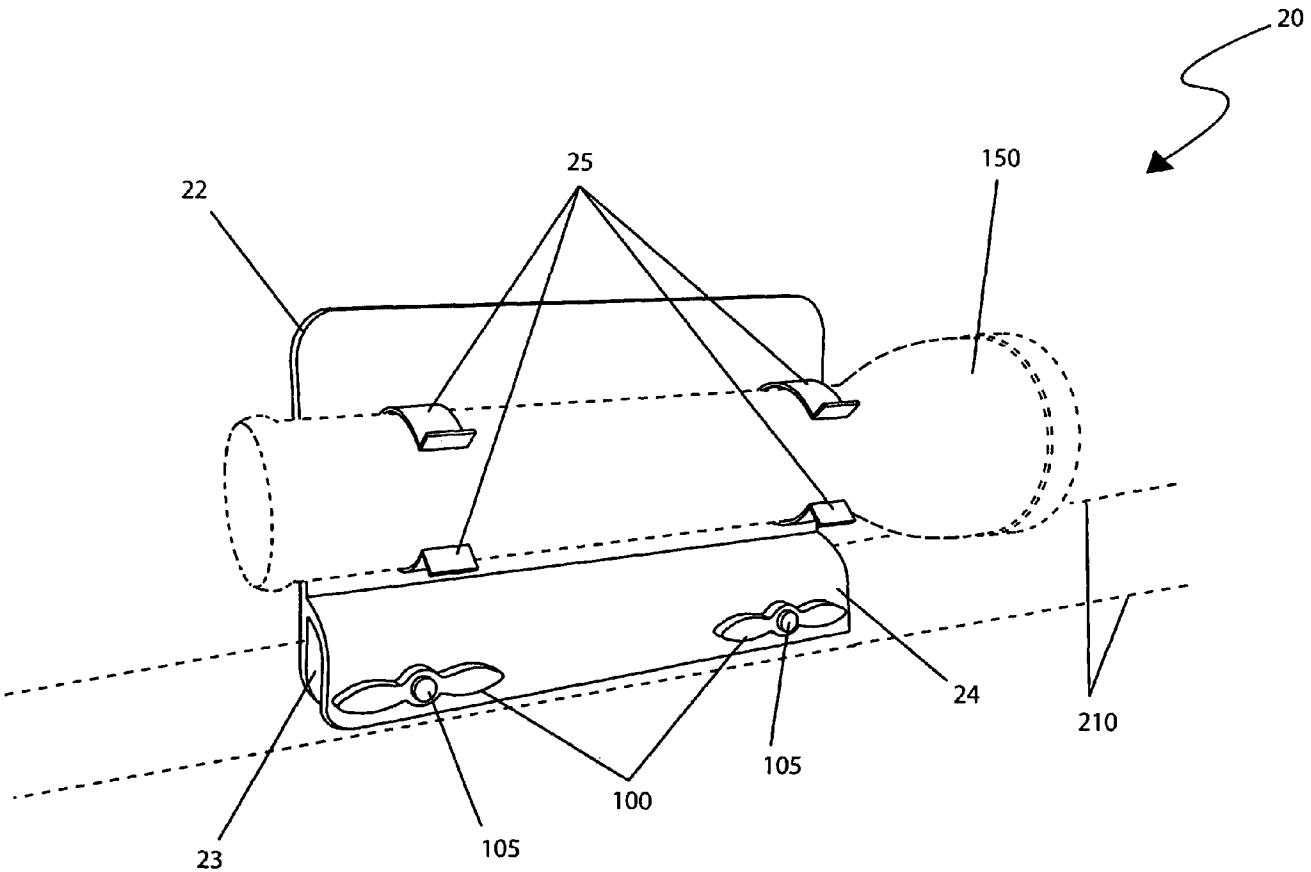
FIG. 3 is a perspective view of a horizontal flashlight holder assembly portion 20 of the object support kit for a bed frame 10, according to the preferred embodiment of the present invention.
Figure 6:
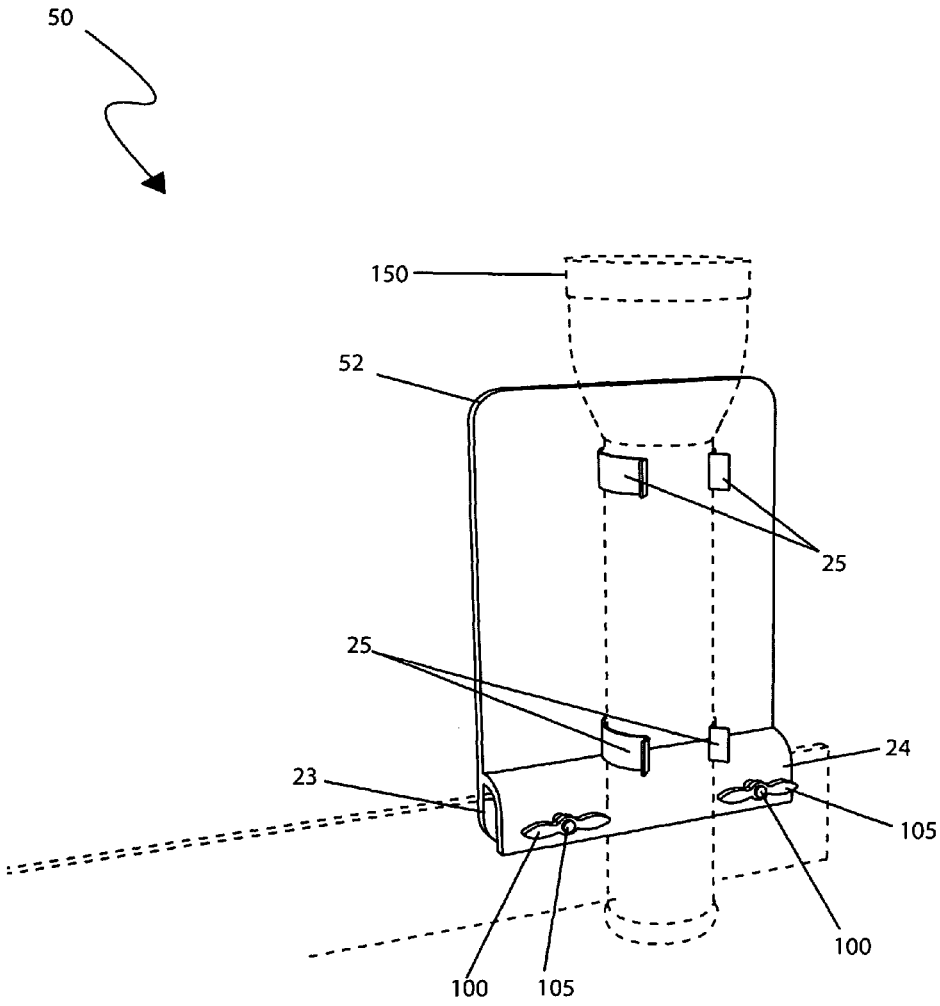
FIG. 6 is a perspective view of a vertical flashlight holder assembly portion 50 of the object support kit for a bed frame 10, according to the preferred embodiment of the present invention; and, FIG. 7 is a perspective view of a bed side tray table assembly portion 60 of the object support kit for a bed frame 10, according to the preferred embodiment of the present invention.

Referring now to FIGS. 3 and 6, perspective views of the horizontal and vertical flashlight holder assemblies 20, 50, respectively, according to the preferred embodiment of the present invention, are disclosed. The horizontal flashlight holder assembly 20 comprises a mounting means thereto a side bed frame 210 along a lower edge in a form of an inverted "U"-shaped anchoring slot 23 being formed therebetween a rear first flashlight holder plate 22 and a parallel anchor plate 24. The anchor plate 24 is positioned in a parallel manner thereto said first flashlight holder plate 22 curving toward and being affixed thereto approximately two (2) inches above a lower edge thereof preferably using a plastic molding process. The anchor slot 23 is approximately three-eighth (%) inches wide so as to slidingly receive an upper edge of the side bed frame 210 therewithin for securing said horizontal flashlight holder assembly 20 thereto said bed frame 210. The anchor slot 23, once installed thereonto said side bed frame portion 210, grasps the top and both side surfaces of said bed frame 210 to secure the horizontal flashlight holder assembly 20 in a perpendicular arrangement relative to a subjacent floor surface. The anchor plate 24 is to be positioned thereat an outward location away from the bed 200 and further comprises a threaded clamping means thereto said bed frame 210 using preferably a pair of widely-spaced wing bolts 100, or other equivalent fasteners, and corresponding threaded apertures 105. The wing bolts 100 are inserted therethrough said threaded aperture portions 105 of the anchor plate 24, subsequently applying a clamping force thereto the side bed frame 210 preventing the horizontal flashlight holder assembly 20 and consequently the flashlight 150 secured thereto, from being unintentionally detached.

The horizontal flashlight holder plate 22 further comprises four (4) clips 25 integrated thereupon an outward facing surface. The clips 25 are fabricated of an elastic material, preferably plated spring steel, and arranged in pairs so as to securely grasp said flashlight 150 therearound outer surfaces thereof. Securing of the flashlight 150 is accomplished by forcing said flashlight 150 therebetween the pairs of clips 25, thereby motioning said clips 25 temporarily outwardly therefrom one another due to their springing nature. The flashlight 150 comes to rest and is secured thereagainst the first flashlight holder plate 22 as the clips 25 return to their original position, thereby permitting easy removal of the flashlight 150 therefrom.

The vertical flashlight assembly 50 comprises similar function, materials and attachment means as the aforementioned horizontal flashlight holder assembly 20 but provides an altered orientation thereof the flashlight 150 thereto a vertical position via a second flashlight holder plate 52 comprising respective reoriented anchor slot 23 and anchor plate 24 portions as shown.

Figure 4:
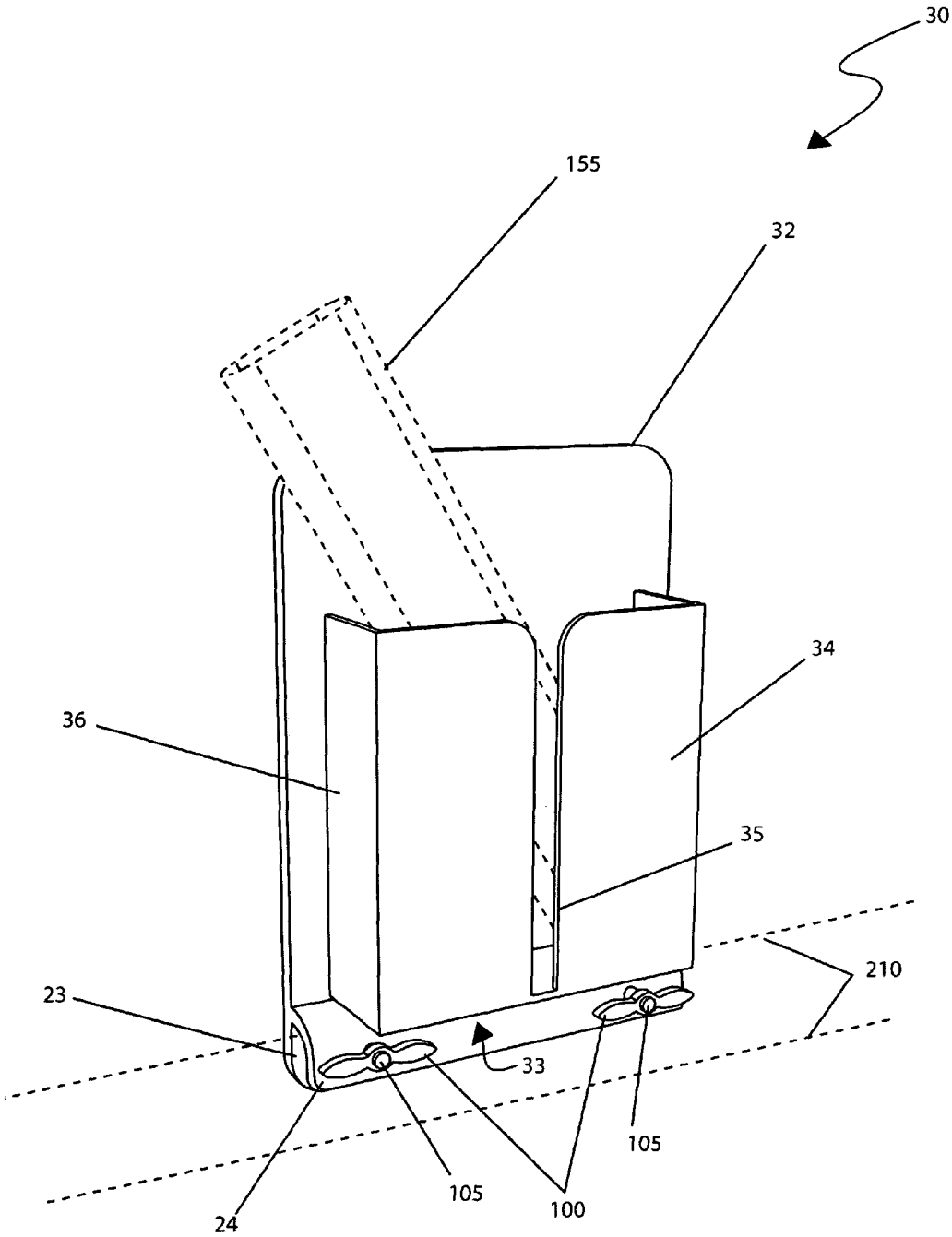
FIG. 4 is a perspective view of a miscellaneous items holder assembly portion 30 of the object support kit for a bed frame 10, according to the preferred embodiment of the present invention.

Referring now to FIG. 4, a perspective view of a miscellaneous items holder assembly portion 30 of the apparatus 10, according to the preferred embodiment of the present invention, is disclosed. The miscellaneous items holder assembly 30 comprises a similar attachment and clamping means as the aforementioned horizontal flashlight holder assembly 20 comprising integration of an anchor plate 24 thereto the vertical miscellaneous items holder plate 32 to form an anchor slot 23 as shown. The miscellaneous items holder assembly 30 provides a rectangular enclosure comprising a bottom wall 33, a front slot 35, two (2) side walls 36, and a front wall 34, thereby defining a five-sided rectangular structure approximately six (6) inches tall, four (4) inches wide, and one-and-one-half (1½) inches deep, leaving a top portion open for removably receiving miscellaneous items such as a remote control 155 and other such items. It is envisioned that the miscellaneous items holder assembly 30 may be introduced in a plurality of dimensions to accommodate a variety of objects to be inserted therein. The slot portion 35 of the miscellaneous items holder assembly 30 is approximately one-half (½) inch wide and is positioned vertically at an intermediate location thereupon the front wall 34, thereby providing convenient visibility of items contained therein. The front wall portion 34 of the miscellaneous items holder assembly 30 comprises a narrower width in comparison with the miscellaneous items holder plate 32, thus providing a means to easily grasp a television remote 155 for example, with one's fingers and remove, as desired.

Figure 5:
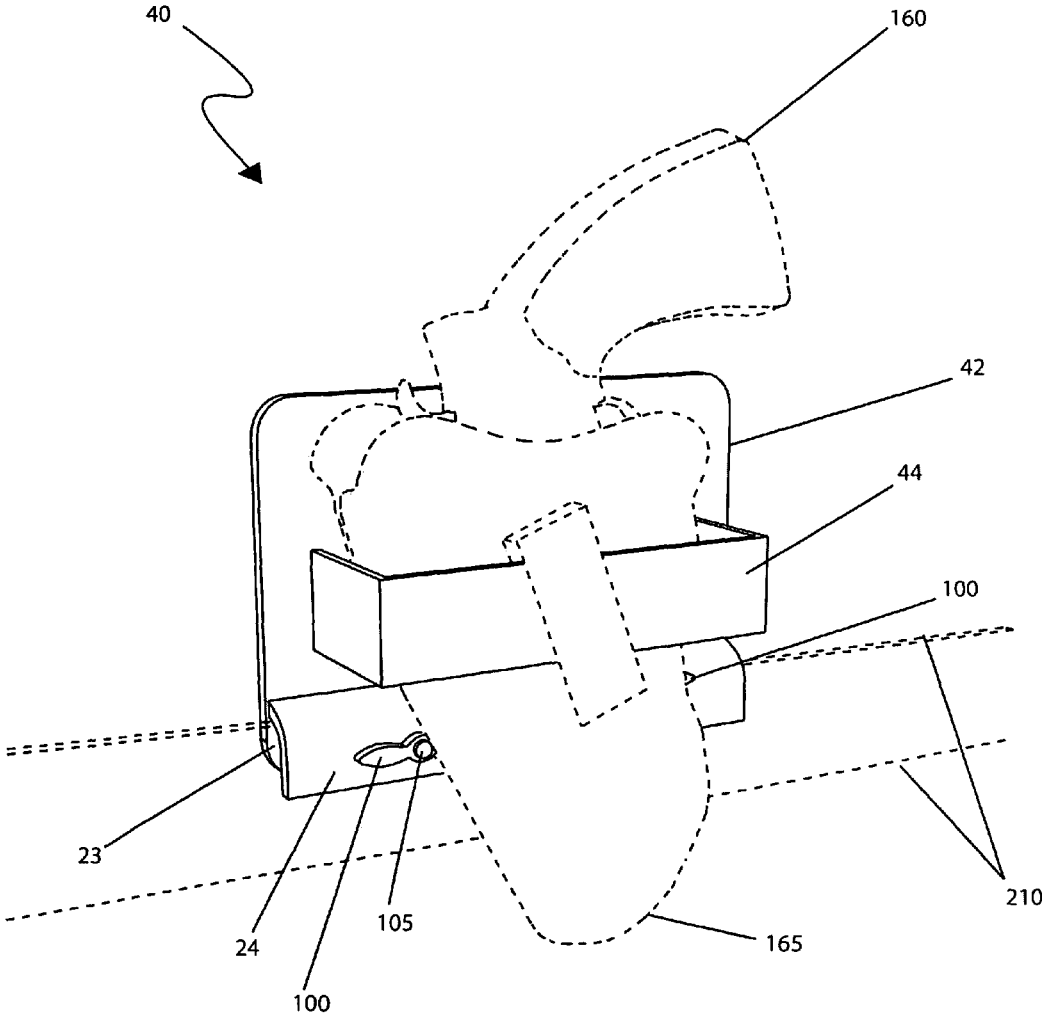
FIG. 5 is a perspective view of a pistol holder assembly portion 40 of the object support kit for a bed frame 10, according to the preferred embodiment of the present invention.

Referring now to FIG. 5, a perspective view of a pistol holder assembly portion 40 of the apparatus 10, according to the preferred embodiment of the present invention, is disclosed. The pistol holder assembly 40 provides a secure and easily accessible means thereto a pistol 160 or other similar-sized weapon along a side bed frame 210. The pistol holder assembly 40 comprises a similar attachment and clamping means as the aforementioned horizontal flashlight holder assembly 20 comprising integration of an anchor plate 24 thereto the vertical rectangular pistol holder front plate 42 to form an anchor slot 23. The pistol holder front plate 42 provides an integrated "U"-shaped first bracket 44 extending horizontally outward therefrom a front surface so as to enable insertion therewithin of a pistol 160 and/or holster 165. The first bracket 44 would be integrated in such a manner to frictionally accept and hold portions of a conventional pistol holster 165 such as a standard belt clip. It is envisioned that additional attachment means to secure other styles of pistols 160 and/or holsters 165 thereto said first bracket 44 may be provided such as one (1) or more hook-and-loop straps being temporarily or permanently attached thereto said pistol holder front plate 42 or first bracket 44 to encircle and thereby secure a pistol 160 and/or a holster 165 therewithin said straps for later retrieval.

Figure 7:
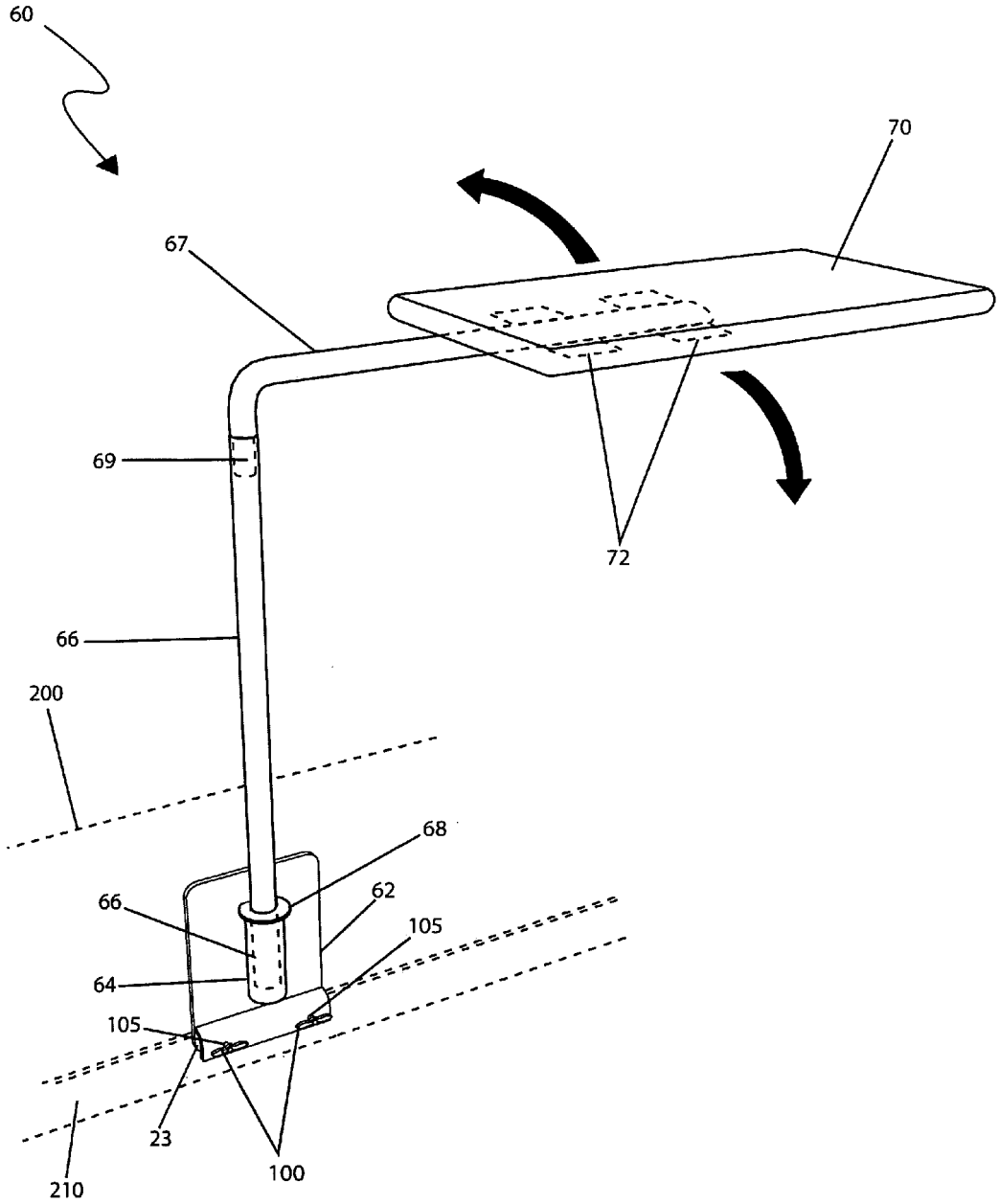

Referring now to FIG. 7, a perspective view of a bed side tray table assembly portion 60 of the apparatus 10, according to the preferred embodiment of the present invention, is disclosed. The bed side tray table assembly 60 provides positioning of a generally rectangular tray table surface 70 approximately twenty-four (24) inches wide by twelve (12) inches deep which swings along a horizontal plane from a bedside position thereto a serving position in regards thereto an occupant in a laying position in a similar manner as that of a standard hospital bed tray. The bed side tray table assembly 60 comprises a similar attachment and clamping means thereto the side bed frame 210 as the aforementioned horizontal flashlight holder assembly 20 comprising integration of an anchor plate 24 thereto a vertical bed side tray table plate 62 to form an anchor slot 23. The bed side tray table assembly 60 further comprises a tubular post receiver 64, a first post 66, a second post 67, a pivot ring 68, and a connecting pin 69. The bed side tray table plate 62 provides an integrally molded or welded attachment means thereto the post receiver 64 along an outward facing surface thereof. The post receiver 64 comprises a cylindrical shape having a hollow core extending along a vertical axis. The post receiver 64 comprises a particularly sized inner diameter so as to slidingly and rotatingly receive the first post portion 66 therein a top open portion thereof. The first post 66 comprises a vertical length of solid metal or plastic rod stock approximately one (1) inch in diameter which extends in an upward direction approximately eighteen (18) inches. The first post 66 comprises a molded-in annular pivot ring 68 located approximately four (4) inches from a bottom end portion, thereby providing a vertical mechanical stop mechanism and a load bearing surface thereto. The first post 66 further provides inserting attachment thereto the second post 67 thereat an upper end portion via an integral female opening sized so as to snuggly receive a connecting pin portion 69 of the second post 67, thereby forming essentially a single-piece when connected. The second post 67 extends in an upward direction therefrom said connection thereto the first post 66 approximately one (1) inch being formed thereat a ninety degree (90°) angle and extending horizontally approximately twenty-four (24) inches. The second post 67 is in-turn affixed thereto a bottom surface of the aforementioned tray table 70 being preferably integrally molded thereto or may be fastened thereto using a pair of common tube-fastening second brackets 72 as illustrated here.

The preferred embodiment of the present invention can be utilized by the common user in a simple and effortless manner with little or no training. After initial purchase or acquisition of the device 10, it would be installed and configured as indicated in FIG. 1.

The method of utilizing the device 10 may be achieved by performing the following steps: opening the carrying case 80 by unlatching the clasp 85; selecting one (1) or more holders 20, 30, 40, 50, and/or the tray table assembly 60, to be attached thereto the side bed frame 210 by a user; engaging the "U"-shaped anchor slot 23 of each holder portion 20, 30, 40, 50, or anchor 60 in a sequential manner thereupon either a right or left side bed frame portion 210 of a bed 200; fastening said "U"-shaped anchor slot portions 23 by tightening the pairs of wing bolts 100 thereto the bed frame 210; loading various objects such as, but not limited to: remote controls 155, flashlights 150, a pistol 160, bed operating controls, reading material, lotions, snacks, and the like, therein said holders 20, 30, 40, 50; removing said objects 150, 155, 160 therefrom the holders 20, 30, 40, 50 as needed; inserting the first 66 and second 67 post portions of the bed side tray table assembly 60 therewithin the post receiver 64; positioning said bed side tray table assembly 60 as desired.

Said holding and anchoring portions 20, 30, 40, 50, 60 are envisioned to be interchangeable, as desired by the user. The apparatus 10 is designed to be removably mounted thereupon a bed frame 210 at a location where said apparatus 10 would allow a user to easily retrieve objects therefrom while still concealing the apparatus 10 and contained objects 31, 32, 35 stored therewithin under a bed covering 220. The apparatus 10 is preferably colored and decorated to match that of the bedroom décor to further camouflage the apparatus 10 as well as being aesthetically pleasing. The apparatus 10 may be removed therefrom the bed frame 210 by removing the wing nut fasteners 100 and compactly storing some or all portions 20, 30, 40, 50, 60 of said apparatus 10 therein the carrying case 80 until needed again.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An object support kit having a plurality of component parts each capable of being attached to a bed frame to provide support of a plurality of prescribed articles adjacent to an edge of a mattress, said kit comprising:

a first flashlight holding plate further comprising an L-shaped first flashlight anchor plate protruding outwardly from a lower end to form an inverted U-shaped first flashlight anchoring slot along a lower edge to receive an upper edge of said bed frame, at least one pair of first flashlight threaded apertures disposed through said first flashlight anchor plate in which a first pair of threaded fasteners is inserted to clamp said bed frame within said first flashlight anchoring slot, and a pair of horizontally aligned first flashlight clips to releasable receive a first flashlight in a horizontal orientation;

an item holding plate further comprising an L-shaped item anchor plate protruding outwardly from a lower end to form an inverted U-shaped item anchoring slot along a lower edge to receive an upper edge of said bed frame, at least one pair of item threaded apertures disposed through said item anchor plate in which a second pair of threaded wing fasteners is inserted to clamp said bed frame within said item anchoring slot, and a rectangular panel having three sides, a closed bottom, and an open top end protruding outwardly from said item holding plate and defining an enclosure for holding at least one item;

a pistol holding plate further comprising an L-shaped pistol anchor plate protruding outwardly from a lower end to form an inverted U-shaped pistol anchoring slot along a lower edge to receive an upper edge of said bed frame, at least one pair of pistol threaded apertures disposed through said pistol anchor plate in which a third pair of threaded fasteners is inserted to clamp said bed frame within said pistol anchoring slot, and a pistol holding bracket protruding outwardly from said pistol holding plate and defining an open area for insertion of a pistol;

a second flashlight holding plate further comprising an L-shaped second flashlight anchor plate protruding outwardly from a lower end to form an inverted U-shaped second flashlight anchoring slot along a lower edge to receive an upper edge of said bed frame, at least one pair of second flashlight threaded apertures disposed through said second flashlight anchor plate in which a fourth pair of threaded wing fasteners is inserted to clamp said bed frame within said second flashlight anchoring slot, and a pair of vertically aligned second flashlight clips to releasable receive a second flashlight in a vertical orientation;

a tray table holding plate further comprising an L-shaped tray table anchor plate protruding outwardly from a lower end to form an inverted U-shaped tray table anchoring slot along a lower edge to receive an upper edge of said bed frame, at least one pair of tray table threaded apertures disposed through said tray table anchor plate in which a fifth pair of threaded fasteners is inserted to clamp said bed frame within said tray table anchoring slot, and a generally tubular post receiver protruding outwardly from said tray table holding plate to removably receive a vertical post of an attachable tray table; and, a carrying case further comprising a plurality of cavities for holding said first flashlight holding plate, said item holding plate, said pistol holding plate, said second flashlight holding plate, said tray table holding plate, and said tray table;

wherein each of said first flashlight holding plate, said item holding plate, said pistol holding plate, said second flashlight holding plate, and said tray table holding plate are adjacent and parallel to a side of said mattress such that each is discreetly concealed by bedding when applied to said mattress; and, wherein said first flashlight holding plate, said item holding plate, said pistol holding plate, said second flashlight holding plate, and said tray table holding plate are adapted to be attachable to any position along either opposing side of said upper edge of said bed frame.

2. The kit of claim 1, wherein each of said pair of threaded apertures is disposed adjacent to opposing side edges of each of said anchor plates such as to prohibit rotational movement of said holding plates relative to said bed frame.

3. The kit of claim 2, wherein said pistol holding plate further comprises at least one pair of hook-and-loop fastening straps affixed to said pistol holder plate to communicatingly engage around and retain said pistol within said open area.

4. The kit of claim 3, wherein each of said pairs of threaded fasteners further comprises a wing bolt.

5. The kit of claim 4, wherein each of said pairs of first flashlight clips further comprises a pair of deformable curved arms that deflect outward to receive and release said first flashlight.

6. The kit of claim 5, wherein each of said pairs of second flashlight clips further comprises a pair of deformable curved arms that deflect outward to receive and release said second flashlight.

7. The kit of claim 6, wherein said rectangular panel further comprises an elongated slot centrally disposed through a front side to receive a finger of a user when retrieving said at least one item from within said enclosure.

8. The kit of claim 7, wherein said tray table further comprises a horizontal post connected to an upper end of said vertical post, a table surface disposed above said horizontal post at a lower surface; and at least two brackets for fastening said table surface to said horizontal post;

wherein said tray table pivots from a bedside position to a serving position.

* * * * *